US010975755B2

(12) United States Patent
Yang

(10) Patent No.: US 10,975,755 B2
(45) Date of Patent: Apr. 13, 2021

(54) STRUCTURE MOUNTED IN WATER JACKET FOR CYLINDER BLOCK

(71) Applicants: Hyundai Motor Company, Seoul (KR); Kia Motors Corporation, Seoul (KR)

(72) Inventor: Il Suk Yang, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/551,943

(22) Filed: Aug. 27, 2019

(65) Prior Publication Data

US 2020/0173338 A1 Jun. 4, 2020

(30) Foreign Application Priority Data

Dec. 4, 2018 (KR) ..... 10-2018-0154498

(51) Int. Cl.
*F01P 3/02* (2006.01)
*F02F 1/10* (2006.01)

(52) U.S. Cl.
CPC ..... *F01P 3/02* (2013.01); *F02F 1/10* (2013.01); *F01P 2003/021* (2013.01); *F02F 2001/104* (2013.01)

(58) Field of Classification Search
CPC ..... F01P 3/02; F01P 2003/021; F02F 1/10; F02F 2001/104; F02F 1/14; F02F 11/005; F02F 1/16
See application file for complete search history.

(56) References Cited

FOREIGN PATENT DOCUMENTS

| | | | | |
|---|---|---|---|---|
| FR | 2769943 A1 * | 4/1999 | ..... | E06B 3/308 |
| KR | 2013055310 A * | 5/2013 | | |
| WO | WO-2017082348 A1 * | 5/2017 | ..... | F01P 3/02 |

* cited by examiner

*Primary Examiner* — Jacob M Amick
*Assistant Examiner* — Charles Brauch
(74) *Attorney, Agent, or Firm* — Slater Matsil, LLP

(57) ABSTRACT

A structure is mounted in a water jacket for a cylinder block of an engine. The structure includes a body forming a housing mounting portion including a panel formed in an arc shape so as to have inner and outer curved surfaces to be surrounded by a block bore. A pad-housing is formed in a plate shape to have curved surfaces with a curvature equal to the inner and outer curved surfaces of the housing mounting portion. The pad-housing is inserted into a housing mounting hole and is formed in a shape to correspond with the housing mounting hole. A pad is formed in a shape to correspond with a pad mounting hole which is bored through the pad-housing through. The pad has a curved surface and is inserted into the pad mounting hole to achieve water tightness.

20 Claims, 8 Drawing Sheets

STRUCTURE MOUNTED IN WATER JACKET FOR CYLINDER BLOCK

CROSS-REFERENCE TO RELATED APPLICATIONS

This application claims priority to Korean Patent Application No. 10-2018-0154498, filed in the Korean Intellectual Property Office on Dec. 4, 2018, which application is hereby incorporated herein by reference.

TECHNICAL FIELD

Embodiments relate to a structure mounted in a water jacket for a cylinder block.

BACKGROUND

Generally, heat generated from a combustion chamber of an engine is absorbed to a cylinder head, a cylinder block, an intake/exhaust valve, a piston, and so on, a water jacket through which coolant is flowed for cooling an engine is formed at a cylinder block and a cylinder head so as to often circulate coolant in a up and down direction of an engine.

If heat is absorbed to the constituent components of the engine, thereby excessively increasing temperature thereof, heat strain thereof may be occurred or lubrication fail may be generated as oil film coated an interior surface of the cylinder is removed. Thus, fault of the engine may be occurred, and fault of the engine is cause of abnormal combustion such as miss ignition, knocking, or pre-ignition. The abnormal combustion may damage the piston, and as a result, there is a problem that thermal efficiency and output of the engine may be deteriorated. On the other hand, there are problems that output and fuel consumption of the engine may be deteriorated and low temperature abrasion of the cylinder may be occurred by excessively cooling the engine. Therefore, it is required that cooling of the engine by coolant is properly controlled.

However, if configuration of a water jacket is to be complex by considering each cooling performance being applying to respectively parts when a cooling type of circulating coolant through the water jacket is used, productivity may be deteriorated as a process for manufacturing the water jacket is to be convoluted. Meanwhile, if a water jacket having simple configuration is applied for improving productivity, cooling performance may be deteriorated or unnecessary cooling may be excessively performed to any part according to difference between each cross-section of respectively parts.

The above information disclosed in this Background section is only for enhancement of understanding of the background of the invention and therefore it may contain information that does not form the prior art that is already known in this country to a person of ordinary skill in the art.

SUMMARY

Embodiments of the present invention relate to a structure mounted in a water jacket for a cylinder block, for example, to a structure mounted in a water jacket for a cylinder block for efficiently cooling an engine.

Embodiments of the present invention provide a structure mounted in a water jacket for a cylinder block having advantages of preventing unnecessary cooling by a water jacket for a cylinder block, and simultaneously, improving an overall cooling performance to required parts.

A structure mounted in a water jacket for a cylinder block according to an exemplary embodiment of the present invention may be a structure that is arranged in a water jacket formed to surround a block bore at a cylinder block of an engine.

The structure mounted in a water jacket for a cylinder block according to an exemplary embodiment of the present invention may include a body forming a housing mounting portion which is a panel formed in an are shape to have curve surfaces as both surfaces so as to surround the block bore. A pad-housing formed in a plate shape to have curve surfaces has a curvature to be equal to the housing mounting portion as both surfaces and inserted into the housing mounting hole and formed in a shape to correspond with a housing mounting hole which is bored to the housing mounting portion through both surfaces respectively having a curve surface so as to be inserted into the housing mounting hole such that water tightness is ensured. A pad is formed in a shape to correspond with a pad mounting hole which is bored to the pad-housing through both surfaces respectively having a curve surface and inserted into the pad mounting hole such that water tightness is ensured.

The body may be disposed at a part in an up and down direction of the water jacket.

The body may be formed of a plastic material.

The pad-housing may be formed of a plastic material.

The body may be formed in a plate shape that at least two housing mounting portions are arranged, and the pad-housing and the pad may be mounted to each housing mounting portion.

The pad may be formed of a hydrophilic expansion rubber material.

The housing mounting portion may include a housing mounted upper end closing an upper side of the housing mounting hole; a housing mounted lower end disposed to face to the housing mounted upper end and adapted to close a lower side of the housing mounting hole; a housing mounted one end connecting the housing mounted upper end with the housing mounted lower end and closing one side of the housing mounting hole; and a housing mounted other end disposed to face to the housing mounted one end and adapted to connect the housing mounted upper end with the housing mounted lower end and close the other side of the housing mounting hole.

The pad-housing may include a pad mounted upper end coupled to the housing mounted upper end so as to ensure water tightness and adapted to close an upper side of the pad mounting hole; a pad mounted lower end coupled to the housing mounted lower end so as to ensure water tightness and disposed to face to the pad mounted upper end so as to close a lower side of the pad mounting hole; a pad mounted one end coupled to the housing mounted one end so as to ensure water tightness and adapted to connect the pad mounted upper end with the pad mounted lower end and to close one side of the pad mounting hole; and a pad mounted other end coupled to the housing mounted other end so as to ensure water tightness and disposed to face to the pad mounted one end so as to connect the pad mounted upper end with the pad mounted lower end and to close the other side of the pad mounting hole.

The pad may include a pad upper end coupled to the pad mounted upper end so as to ensure water tightness; a pad lower end coupled to the pad mounted lower end so as to ensure water tightness; a pad one end coupled to the pad mounted one end so as to ensure water tightness; and a pad other end coupled to the pad mounted other end so as to ensure water tightness.

The pad-housing may further include an interior circumference protrusion protruded toward the pad mounting hole along interior circumferences of the pad mounted upper end, the pad mounted one end, the pad mounted lower end, and the pad mounted other end.

The pad may further include an interior protrusion coupling groove recessed in a shape to correspond with the interior circumference protrusion along the pad upper end, the pad one end, the pad lower end, and the pad other end such that the interior circumference protrusion is seated thereon.

The interior circumference protrusion may be formed so as to be continuously protruded to cross the pad mounted upper end, the pad mounted one end, the pad mounted lower end, and the pad mounted other end.

The pad-housing may further include a stiffening rib formed in a bar shape to connect the interior circumference protrusion which is formed at the pad mounted one end with the interior circumference protrusion which is formed at the pad mounted other end so as to partition the pad mounting hole into two sections.

The pad may further include a rib hole bored into the pad from the interior protrusion coupling groove which is formed at the pad mounted one end to the interior protrusion coupling groove which is formed at the pad mounted other end and formed in a shape to correspond with the stiffening rib such that the stiffening rib is sat thereon.

The pad mounting hole may be halved by the stiffening rib.

The interior protrusion coupling groove may be formed to be continuously recessed to cross the pad upper end, the pad one end, the pad lower end, and the pad other end.

The pad may be directly injection-molded to the pad-housing.

Thicknesses of the pad mounted upper end, the pad mounted lower end, the pad mounted one end, and the pad mounted other end may be equal, and a thickness of the pad may be formed to be uniform and to be equal to thicknesses of the pad mounted upper end, the pad mounted lower end, the pad mounted one end, and the pad mounted other end when the pad is injection-molded.

When coolant is flowed in the water jacket, the pad contacting coolant may be expended in a thickness direction so as to contact to the cylinder block in a state that it is limited by respective the pad mounted upper end, the pad mounted lower end, the pad mounted one end, and the pad mounted other end that the pad upper end, the pad lower end, the pad one end, and the pad other end are respectively expanded.

The body may further include a housing coupling groove formed at least one to respective the housing mounted upper end, the housing mounted lower end, the housing mounted one end, and the housing mounted other end so as to be recessed toward an exterior side from an interior circumference.

The pad-housing may further include: an exterior circumference protrusion protruded toward an exterior side along exterior circumferences of the pad mounted upper end, the pad mounted one end, the pad mounted lower end, and the pad mounted other end; and a body coupling protrusion protruded from the exterior circumference protrusion and adapted so that a part thereof is formed in a shape to correspond with the housing coupling groove so as to be seated on the housing coupling groove.

The exterior circumference protrusion may be formed so as to be continuously protruded to cross the pad mounted upper end, the pad mounted one end, the pad mounted lower end, and the pad mounted other end.

The body coupling protrusion may include: a seated portion formed in a semicircle along an exterior circumference of the exterior circumference protrusion, as the part to be seated on the housing coupling groove; a blocked portion adapted to have a radius which is longer than a radius of the seated portion and formed in a semicircle to be concentrically arranged in a thickness direction; and a slanted surface formed to be slanted with respect to a center of the circle of the blocked portion such that a radius of the blocked portion is gradually reduced as receding from the seated portion, as an external circumference of the blocked portion.

A coupling protrusion supported portion, which is a portion to surround the housing coupling groove formed at respective the housing mounted upper end, the housing mounted lower end, the housing mounted one end, and the housing mounted other end, may be contacted to an exterior side of the seated portion and be contacted to the blocked portion in a thickness direction.

The structure mounted in a water jacket for a cylinder block according to an exemplary embodiment of the present invention may further include: an exterior protrusion supported portion protruded toward an interior side along interior circumferences of the housing mounted upper end, the housing mounted one end, the housing mounted lower end, and the housing mounted other end; and a body supported portion protruded toward an exterior side along an exterior circumference of the exterior circumference protrusion.

The body supported portion may be contacted to interior sides of the housing mounted upper end, the housing mounted one end, the housing mounted lower end, and the housing mounted other end and be contacted to the exterior protrusion supported portion in a thickness direction.

The exterior protrusion supported portion may be formed to be continuously protruded to cross the housing mounted upper end, the housing mounted one end, the housing mounted lower end, and the housing mounted other end except parts of forming the housing coupling groove.

The body supported portion may be formed to be continuously protruded to cross the whole of the exterior circumference protrusion except parts of forming the body coupling protrusion.

One direction surface in a thickness direction of the coupling protrusion supported portion may be contacted with the other direction surface in a thickness direction of the blocked portion, and the other direction surface in a thickness direction of the exterior protrusion supported portion may be contacted with one direction surface in a thickness direction of the body supported portion.

The body and the pad-housing may be coupled to each other when the blocked portion is passed through the housing coupling groove by using the slanted surface so as to be blocked to the coupling protrusion supported portion in a state that the pad-housing is inserted into the housing mounting hole such that the body supported portion is blocked to the exterior protrusion supported portion.

Figure 1:
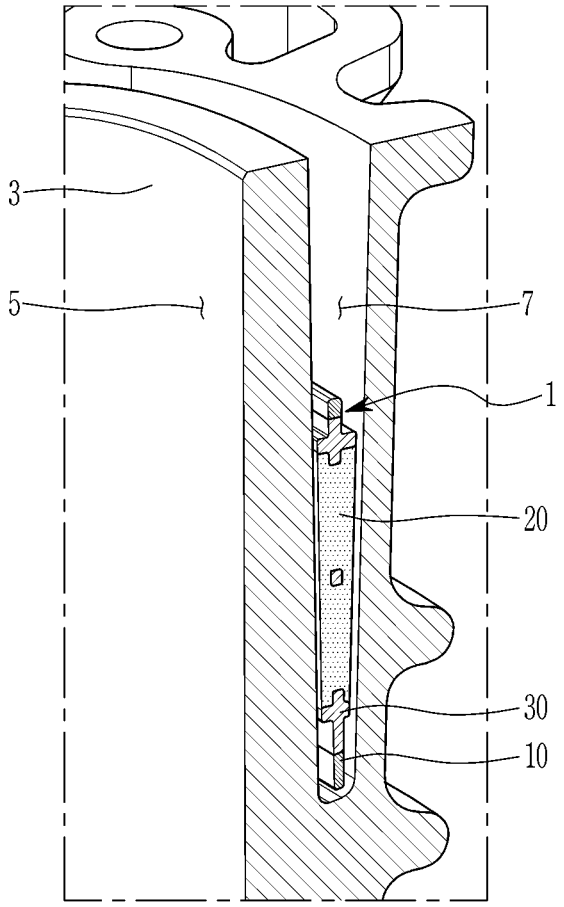
FIG. 1 is a perspective view showing a partial cross section of a cylinder block in which a structure mounted in a water jacket for a cylinder block according to an exemplary embodiment of the present invention is mounted.

The following reference numerals can be used in conjunction with the drawings:

1: structure mounted in a water jacket for a cylinder block
3: cylinder block
5: block bore
7: water jacket
10: body
11: housing mounted upper end
11*b*: coupling protrusion supported portion
11*c*: exterior protrusion supported portion
12: housing mounted lower end
13: housing mounted one end
14: housing mounted other end
15: coupling protrusion
16: housing coupling groove
17: stiffening rib
18: housing mounting portion
19: housing mounting hole
20: pad
21: pad upper end
22: pad lower end
23: pad one end
24: pad other end
25: interior protrusion coupling groove
27: rib hole
30: pad-housing
31: pad mounted upper end
32: pad mounted lower end
33: pad mounted one end
34: pad mounted other end
35: interior circumference protrusion
36: body coupling protrusion
36*a*: seated portion
36*b*: blocked portion
36*c*: slanted surface
37: stiffening rib
38: exterior circumference protrusion
38*c*: body supported portion
39: pad mounting hole

DETAILED DESCRIPTION OF ILLUSTRATIVE EMBODIMENTS

An exemplary embodiment of the present invention will hereinafter be described in detail with reference to the accompanying drawings.

FIG. 1 is a perspective view showing a partial cross section of a cylinder block in which a structure mounted in a water jacket for a cylinder block according to an exemplary embodiment of the present invention is mounted.

As shown in FIG. 1, a structure 1 mounted in a water jacket for a cylinder block according to an exemplary embodiment of the present invention is inserted into a water jacket 7 of a cylinder block 3.

The cylinder block 3 is a portion acting as a center of an engine and is coupled with a lower side of a cylinder head (not shown). In addition, at the cylinder block 3, at least one block bore 5, that is, an ordinary cylinder is formed and a piston is disposed to make a reciprocal motion in the block bore 5. The engine, which is configured by coupling the cylinder head with the cylinder block 3, is well known to a person of an ordinary skill in the art, so a detailed description thereof will be omitted.

The water jacket 7 is an empty space which is formed by arranging a core in a mold when casting the cylinder block 3 and the cylinder head, and is a coolant passage which is disposed around the block bore 5 including a combustion chamber which is formed at the cylinder head. That is, the water jacket 7 is formed at the cylinder block 3, and the water jacket 7 formed at the cylinder block 3 may be disposed to surround a circumference of the block bore 5 which is formed as a cylindrical hollow at the cylinder block 3. Configuration and function of the water jacket 7 are well known to a person of an ordinary skill in the art, so detailed descriptions thereof will be omitted.

At the cylinder block 3, in case that an upward direction is defined as a direction of coupling the cylinder head thereto and a downward direction is defined as a direction of spacing apart from the cylinder head, that is, a direction of arranging a crank case (not shown) and so on, a height of the embed structure 1 is shorter than a height of the water jacket 7. In other words, the embed structure 1 is disposed at a part in an up and down direction of the water jacket 7 in case that a reciprocal motion of the piston which moves in the block bore 5 is defined as an up and down reciprocal motion.

Figure 2:
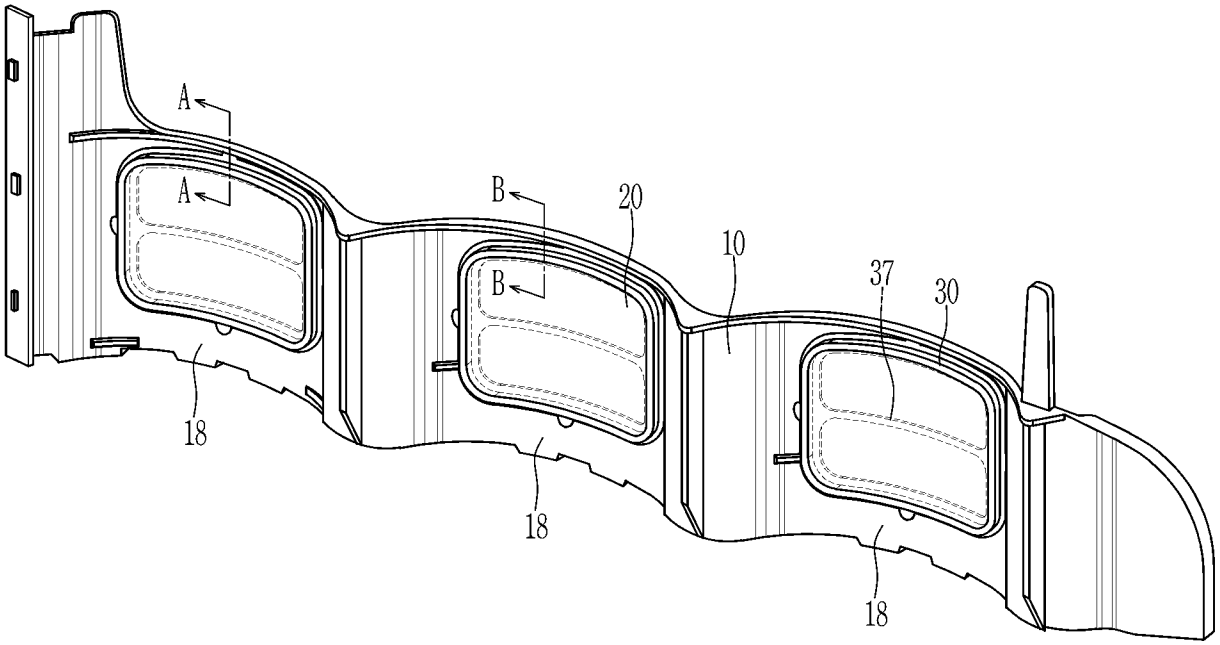
FIG. 2 is a perspective view of a structure mounted in a water jacket for a cylinder block according to an exemplary embodiment of the present invention.
Figure 3:
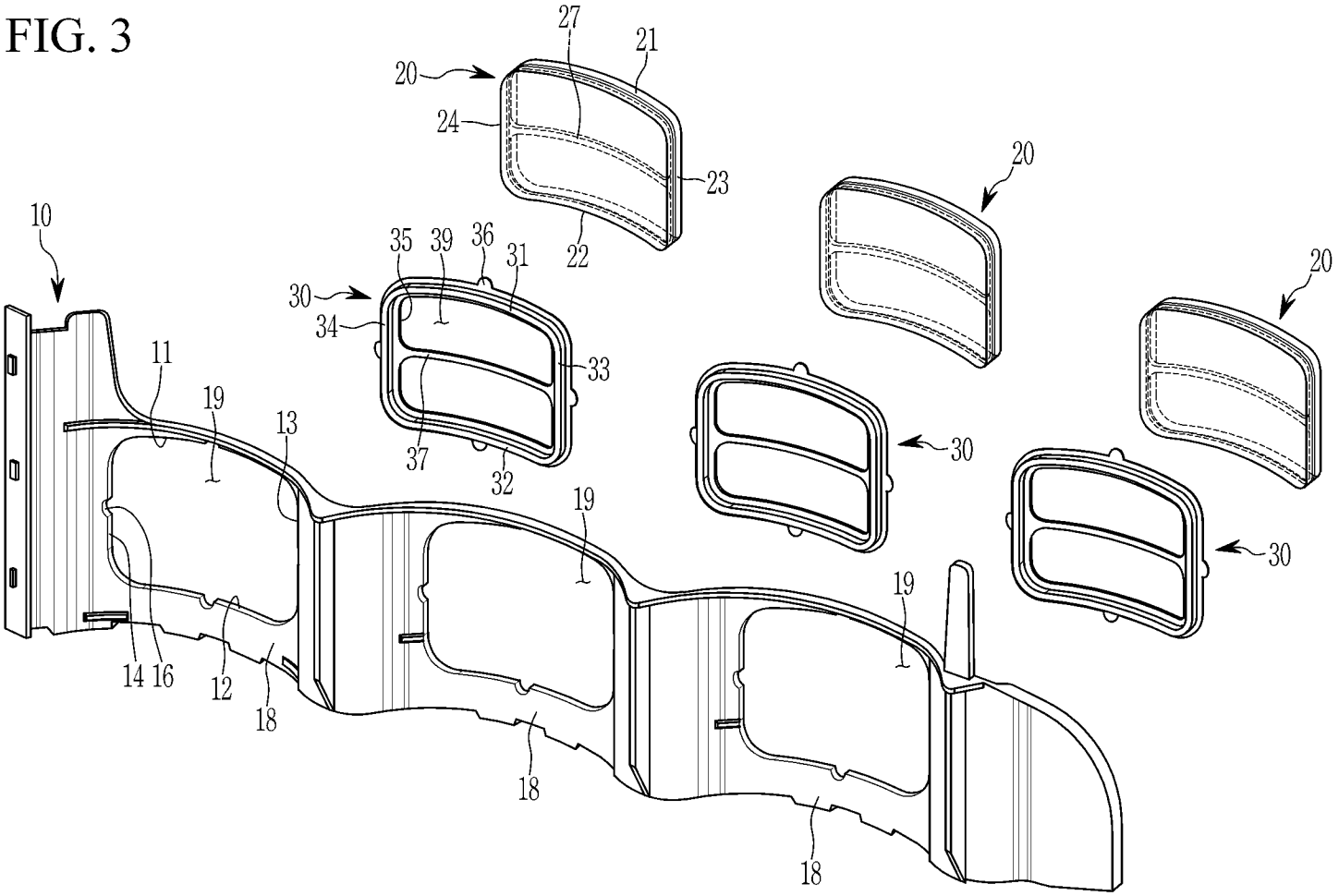
FIG. 3 is an exploded view of a structure mounted in a water jacket for a cylinder block according to an exemplary embodiment of the present invention.

FIG. 2 is a perspective view of a structure mounted in a water jacket for a cylinder block according to an exemplary embodiment of the present invention, and FIG. 3 is an exploded view of a structure mounted in a water jacket for a cylinder block according to an exemplary embodiment of the present invention.

As shown in FIGS. 1 to 3, the embed structure 1 includes a body 10, a pad-housing 30, and a pad 20.

Meanwhile, it is well known to a person of an ordinary skill in the art that the block bores 5 are arranged to form at least one line in multi-cylinder engines and are arranged to form at least two lines in multi-cylinder engines such as a V-type engine.

The body 10 is formed in a plate shape that at least two panels, which are formed in an are shape to have curve surfaces as both surfaces, are arranged and is disposed so that are shapes of the body 10 are arranged in a direction of arranging the block bores 5. In addition, the body 10 is provided at least one such that one are shape of the body 10 surrounds one among the block bores 5 to each one line of the block bore 5, and a pair of the bodies 10 may be provided such that a pair of arc shapes surround both sides of one among the block bores 5. Further, arc shapes may be formed to be same to or less than a number of the block bore 5 at one among the bodies 10 in one line of the block bore 5, but it may be desirable that arc shapes are formed to be same to a number of the block bore 5. Herein, an arc shape portion of the body 10 will be called "housing mounting portion 18". Meanwhile, the body 10 may be formed of a plastic material.

The pad-housing 30 is mounted to each housing mounting portion 18. In addition, the pad-housing 30 is formed in a plate shape to have curve surfaces as both surfaces, and is configured to have a curvature to be equal to the housing mounting portion 18. Further, a housing mounting hole 19 having a shape to correspond with a circumferential edge of the pad-housing 30 is bored through both surfaces respectively formed in a curve surface at the housing mounting portion 18, and the pad-housing 30 is inserted into the housing mounting hole 19 such that water tightness is ensured between the pad-housing 30 and the housing mounting portion 18. Meanwhile, the pad-housing 30 may be formed of a plastic material.

The pad 20 is mounted to each pad-housing 30. In addition, the pad 20 is formed in a plate shape to have curve surfaces as both surfaces, and is configured to have a curvature to be equal to the housing mounting portion 18. Further, a pad mounting hole 39 having a shape to correspond with the pad 20 is bored through both surfaces respectively formed in a curve surface at the pad-housing 30, and the pad 20 is inserted into the pad mounting hole 39 such that water tightness is ensured between the pad 20 and the pad-housing 30. Meanwhile, the pad 20 may be formed of a rubber material and may be a hydrophilic expansion rubber. Herein, a hydrophilic expansion rubber, which is expanded in case of contacting water, is well known to a person of an ordinary skill in the art, so detailed descriptions thereof will be omitted.

Figure 4:
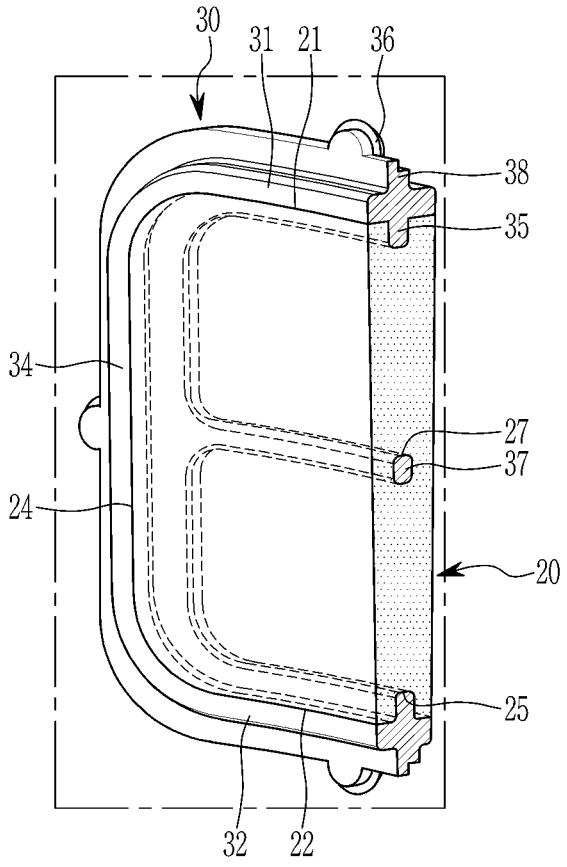
FIG. 4 is a perspective view showing a partial cross section of a structure mounted in a water jacket for a cylinder block according to an exemplary embodiment of the present invention, for illustrating combination of a pad and a pad-housing.

FIG. 4 is a perspective view showing a partial cross section of a structure mounted in a water jacket for a cylinder block according to an exemplary embodiment of the present invention, for illustrating combination of a pad and a pad-housing.

As shown in FIG. 3 and FIG. 4, the housing mounting portion 18 includes a housing mounted upper end 11, a housing mounted lower end 12, a housing mounted one end 13, a housing mounted other end 14, and a housing coupling groove 16, and the pad-housing 30 includes pad mounted upper end 31, pad mounted lower end 32, a pad mounted one end 33, a pad mounted other end 34, an exterior circumference protrusion 38, a body coupling protrusion 36, an interior circumference protrusion 35, and stiffening rib 37, and the pad 20 includes a pad upper end 21, a pad lower end 22, a pad one end 23, a pad other end 24, an interior protrusion coupling groove 25, and a rib hole 27.

The housing mounted upper end 11 is a portion closing an upper side of the housing mounting hole 19. Herein, directions of deciding an upper side, a lower side, and both sides of the housing mounting hole 19 have the same reference with an up and down direction of the water jacket 7.

The housing mounted lower end 12 is a portion closing a lower side of the housing mounting hole 19. That is, the housing mounted lower end 12 faces to the housing mounted upper end 11 such that the housing mounting hole 19 is positioned between the housing mounted lower end 12 and the housing mounted upper end 11.

The housing mounted one end 13 is a portion connecting the housing mounted upper end 11 with the housing mounted lower end 12 and closing one side of the housing mounting hole 19.

The housing mounted other end 14 is a portion connecting the housing mounted upper end 11 with the housing mounted lower end 12 and closing the other side of the housing mounting hole 19. That is, the housing mounted other end 14 faces to the housing mounted one end 13 such that the housing mounting hole 19 is positioned between the housing mounted other end 14 and the housing mounted one end 13.

The housing coupling groove 16 is formed at least one to respective the housing mounted upper end 11, the housing mounted lower end 12, the housing mounted one end 13, and the housing mounted other end 14. In addition, the housing coupling groove 16 is respectively recessed toward the housing mounted upper end 11, the housing mounted lower end 12, the housing mounted one end 13, and the housing mounted other end 14 from the housing mounting hole 19.

The pad mounted upper end 31 is an upper end of the pad-housing 30 which is coupled to the housing mounted upper end 11 so as to ensure water tightness. In addition, the pad mounted upper end 31 closes an upper side of the pad mounting hole 39. Herein, directions of deciding an upper end, a lower end, and both ends of the pad mounting hole 39 have the same reference with an up and down direction of the water jacket 7.

The pad mounted lower end 32 is a lower end of the pad-housing 30 which is coupled to the housing mounted lower end 12 so as to ensure water tightness. In addition, the pad mounted lower end 32 closes a lower side of the pad mounting hole 39. That is, the pad mounted lower end 32 faces to the pad mounted upper end 31 such that the pad mounting hole 39 is positioned between the pad mounted lower end 32 and the pad mounted upper end 31.

The pad mounted one end 33 is one side end of the pad-housing 30 which is coupled to the housing mounted one end 13 so as to ensure water tightness. In addition, the pad mounted one end 33 connects the pad mounted upper end 31 with the pad mounted lower end 32 and closes one side of the pad mounting hole 39.

The pad mounted other end 34 is the other side end of the pad-housing 30 which is coupled to the housing mounted other end 14 so as to ensure water tightness. In addition, the pad mounted other end 34 connects the pad mounted upper end 31 with the pad mounted lower end 32 and closes the other side of the pad mounting hole 39. That is, the pad mounted other end 34 faces to the pad mounted one end 33 such that the pad mounting hole 39 is positioned between the pad mounted other end 34 and the pad mounted one end 33.

The exterior circumference protrusion 38 is formed along an exterior circumference of the pad mounted upper end 31, the pad mounted one end 33, the pad mounted lower end 32, and the pad mounted other end 34, and is protruded from the pad mounted upper end 31, the pad mounted one end 33, the pad mounted lower end 32, and the pad mounted other end 34 toward the body 10. In other words, the exterior circumference protrusion 38 is continuously protruded to cross the pad mounted upper end 31, the pad mounted one end 33, the pad mounted lower end 32, and the pad mounted other end 34 such that water tightness is ensured between the exterior circumference protrusion 38 and the body 10. Herein, an exterior direction is defined to a direction of heading for the body 10 and an interior direction is defined to a direction of heading for the pad 20 in the pad mounted upper end 31, the pad mounted one end 33, the pad mounted lower end 32 and the pad mounted other end 34.

The body coupling protrusion 36 is protruded from the exterior circumference protrusion 38 so as to be seated on the housing coupling groove 16. In addition, the body coupling protrusion 36 includes a part which is formed in a shape to correspond with the housing coupling groove 16 and is seated on the housing coupling groove 16. Further, the body coupling protrusion 36 has a curve surface such as a semicircle along a circumference of the exterior circumference protrusion 38.

The interior circumference protrusion 35 is formed along an interior circumference of the pad mounted upper end 31, the pad mounted one end 33, the pad mounted lower end 32, and the pad mounted other end 34, and is protruded from the pad mounted upper end 31, the pad mounted one end 33, the pad mounted lower end 32, and the pad mounted other end 34 toward the pad mounting hole 39. In other words, the interior circumference protrusion 35 is continuously protruded to cross the pad mounted upper end 31, the pad mounted one end 33, the pad mounted lower end 32, and the pad mounted other end 34 and to surround the pad mounting hole 39.

The stiffening rib 37 is formed in a bar shape to connect the interior circumference protrusion 35 formed at the pad mounted one end 33 with the interior circumference protrusion 35 formed at the pad mounted other end 34. In addition, the stiffening rib 37 partitions the pad mounting hole 39 into two. Meanwhile, it is desirable that the pad mounting hole 39 is halved by the stiffening rib 37, but not limited thereto. Further, the stiffening rib 37 functions so as to reinforce rigidity of the pad-housing 30 to which the pad mounting hole 39 is bored and to increase coherence between the pad-housing 30 and the pad 20. Furthermore, the stiffening rib 37 has a curvature to be equal to the housing mounting portion 18 and the pad-housing 30 and connects the interior circumference protrusion 35 formed at the pad mounted one end 33 with the interior circumference protrusion 35 formed at the pad mounted other end 34.

The pad upper end 21 is an upper end of the pad 20 which is coupled to the pad mounted upper end 31 so as to ensure water tightness. Herein, directions of deciding an upper end, a lower end, and both ends of the pad 20 have the same reference with an up and down direction of the water jacket 7.

The pad lower end 22 is a lower end of the pad 20 which is coupled to the pad mounted lower end 32 so as to ensure water tightness.

The pad one end 23 is one side end of the pad 20 which is coupled to the pad mounted one end 33 so as to ensure water tightness.

The pad other end 24 is the other side end of the pad 20 which is coupled to the pad mounted other end 34 so as to ensure water tightness.

The interior protrusion coupling groove 25 is formed along the pad upper end 21, the pad one end 23, the pad lower end 22, and the pad other end 24, and is recessed in a shape to correspond with the interior circumference protrusion 35 from the pad upper end 21, the pad one end 23, the pad lower end 22, and the pad other end 24 such that the interior circumference protrusion 35 is seated thereon. In other words, the interior protrusion coupling groove 25 is continuously recessed to cross the pad upper end 21, the pad one end 23, the pad lower end 22, and the pad other end 24. Herein, coherence between the pad-housing 30 and the pad 20 is increased, and simultaneously, water tightness is reinforced by a step as the interior circumference protrusion 35 is inserted into the interior protrusion coupling groove 25.

The rib hole 27 is bored into the pad 20 from the interior protrusion coupling groove 25 formed at the pad one end 23 to the interior protrusion coupling groove 25 formed at the pad other end 24. In addition, the rib hole 27 is formed in a shape to correspond with the stiffening rib 37 such that the stiffening rib 37 is seated thereon. Further, coherence between the pad-housing 30 and the pad 20 is increased as the stiffening rib 37 is disposed to be inserted into the rib hole 27. The disposal of inserting the stiffening rib 37 into the rib hole 27 is possible by directly injection-molding the pad 20 having the hydrophilic expansion rubber material to the pad-housing 30.

Meanwhile, thicknesses of the pad mounted upper end 31, the pad mounted lower end 32, the pad mounted one end 33, and the pad mounted other end 34 are equal and are thicker than the other part of the pad-housing 30 if a direction of representing a distance between both surfaces, which are respectively formed in a curve surface, of the housing mounting portion 18 is to be a reference for deciding a thickness of a structure 1 mounted in a water jacket for a cylinder block according to an exemplary embodiment of the present invention, and a thickness of the pad 20, which is equal to thicknesses of the pad upper end 21, the pad lower end 22, the pad one end 23, and the pad other end 24, is formed to be uniform and to be equal to thicknesses of the pad mounted upper end 31, the pad mounted lower end 32, the pad mounted one end 33, and the pad mounted other end 34 when the pad 20 is injection-molded. In this regard, it goes without saying that the pad mounted upper end 31, the pad mounted lower end 32, and the pad 20 have a curvature to be equal to the housing mounting portion 18.

Figure 5:
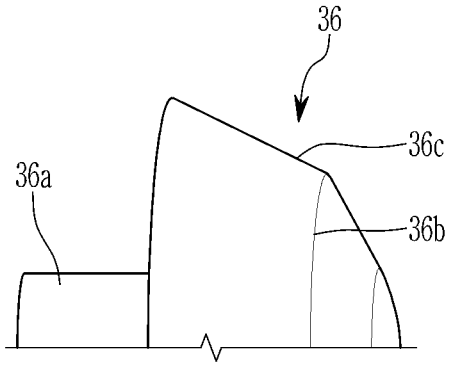
FIG. 5 is a partial enlarged view of FIG. 4.

FIG. 5 is a partial enlarged view of FIG. 4.

As shown in FIG. 5, the body coupling protrusion 36 includes a seated portion 36*a*, a blocked portion 36*b*, and a slanted surface 36*c*.

The seated portion 36*a* is a portion which is seated on the housing coupling groove 16. That is, the seated portion 36*a* is formed in a shape to correspond with the housing coupling groove 16.

The blocked portion 36*b* is concentrically arranged with the seated portion 36*a* and is adapted to have a radius which is longer than a radius of the seated portion 36*a* in case that the body coupling protrusion 36 is formed in a semicircle along a circumference of the exterior circumference protrusion 38. That is, the blocked portion 36*b* is further protruded in comparison with the seated portion 36*a*. In addition, the blocked portion 36*b* and the seated portion 36*a* are arranged in a thickness direction of the pad mounted upper end 31, the pad mounted lower end 32, the pad mounted one end 33, and the pad mounted other end 34. Herein, the blocked portion 36*b* and the seated portion 36*a* are integrally formed to each other.

The slanted surface 36*c* is an external circumference of the blocked portion 36*b* and is formed to be slanted with respect to a center of the circle of the blocked portion 36*b* as a radius of the blocked portion 36*b* is gradually reduced as receding from the seated portion 36*a* in a thickness direction of the body coupling protrusion 36.

Figure 6:
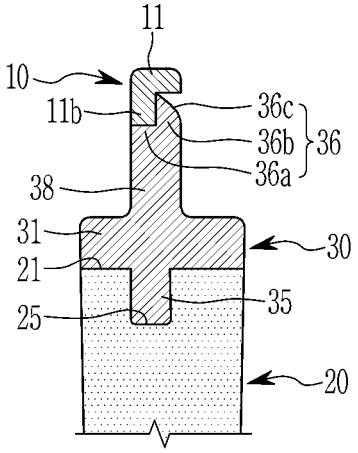
FIG. 6 is a cross-sectional view taken along a line A-A in FIG. 2.

FIG. 6 is a cross-sectional view taken along a line A-A in FIG. 2.

As shown in FIG. 6, the housing mounted upper end 11, the housing mounted lower end 12, the housing mounted one end 13, and the housing mounted other end 14 respectively include a coupling protrusion supported portion 11*b*. Only the housing mounted upper end 11 is illustrated in FIG. 6, but the coupling protrusion supported portion 11*b* is also formed at respective the housing mounted lower end 12, the housing mounted one end 13, and the housing mounted other end 14.

The coupling protrusion supported portion 11*b* is a portion which surrounds the housing coupling groove 16 and is contacted to an exterior side of the seated portion 36*a*. Herein, a direction of deciding an exterior side of the seated portion 36*a* has the same reference with exterior side directions of the pad mounted upper end 31, the pad mounted one end 33, the pad mounted lower end 32, and the pad mounted other end 34. That is, the coupling protrusion supported portion 11*b* is respectively formed at a part of forming the housing coupling groove 16 in the housing mounted upper end 11, the housing mounted lower end 12, the housing mounted one end 13, and the housing mounted other end 14. In addition, a cross section of the coupling protrusion supported portion 11*b* is formed in a shape of being protruded toward the housing mounting hole 19 from the housing mounted upper end 11, the housing mounted lower end 12, the housing mounted one end 13, and the housing mounted other end 14 and to be stepped to the housing mounted upper end 11, the housing mounted lower end 12, the housing mounted one end 13, and the housing mounted other end 14. Thus, the coupling protrusion supported portion 11*b* is contacted with the blocked portion 36*b* in a thickness direction of the pad mounted upper end 31, the pad mounted lower end 32, the pad mounted one end 33, and the pad mounted other end 34.

Figure 7:
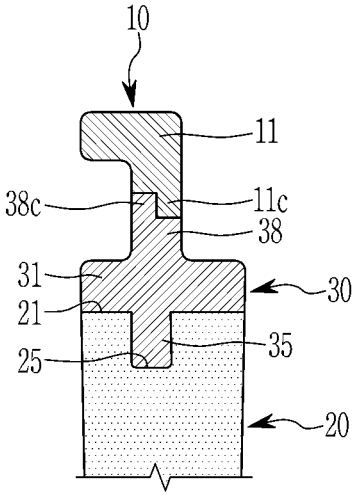
FIG. 7 is a cross-sectional view taken along a line B-B in FIG. 2.

FIG. 7 is a cross-sectional view taken along a line B-B in FIG. 2.

As shown in FIG. 7, respective the housing mounted upper end 11, the housing mounted lower end 12, the housing mounted one end 13, and the housing mounted other end 14 further include an exterior protrusion supported portion 11*c*, and the exterior circumference protrusion 38 includes a body supported portion 38*c*. Only the housing mounted upper end 11 is illustrated in FIG. 7, but the exterior protrusion supported portion 11*c* is also formed at the housing mounted lower end 12, the housing mounted one end 13, and the housing mounted other end 14.

The exterior protrusion supported portion 11*c* is formed along interior circumferences of the housing mounted upper end 11, the housing mounted one end 13, the housing mounted lower end 12, and the housing mounted other end 14, and is protruded toward the pad-housing 30 from the housing mounted upper end 11, the housing mounted one end 13, the housing mounted lower end 12, and the housing mounted other end 14. Meanwhile, the exterior protrusion supported portion 11*c* is continuously protruded to cross the housing mounted upper end 11, the housing mounted one end 13, the housing mounted lower end 12, and the housing mounted other end 14 except parts of forming the housing coupling groove 16. Herein, directions of deciding interior circumferences of the housing mounted upper end 11, the housing mounted one end 13, the housing mounted lower end 12, and the housing mounted other end 14 have the same reference with interior side directions of the pad mounted upper end 31, the pad mounted one end 33, the pad mounted lower end 32, and the pad mounted other end 34.

The body supported portion 38*c* is formed along an exterior circumference of the exterior circumference protrusion 38, and is protruded toward the body 10 from the exterior circumference protrusion 38. Meanwhile, the body supported portion 38*c* is continuously protruded except parts of forming the body coupling protrusion 36. In addition, the body supported portion 38*c* is contacted with interior sides of the housing mounted upper end 11, the housing mounted one end 13, the housing mounted lower end 12, and the housing mounted other end 14. Herein, a direction of deciding an exterior circumference of the exterior circumference protrusion 38 and directions of deciding interior sides of the housing mounted upper end 11, the housing mounted one end 13, the housing mounted lower end 12, and the housing mounted other end 14 have the same reference with interior and exterior side directions of the pad mounted upper end 31, the pad mounted one end 33, the pad mounted lower end 32, and the pad mounted other end 34. Further, the body supported portion 38*c* is contacted to the exterior protrusion supported portion 11*c* in a thickness direction of the pad mounted upper end 31, the pad mounted lower end 32, the pad mounted one end 33, and the pad mounted other end 34.

In this regard, if one direction surface in a thickness direction of the coupling protrusion supported portion 11*b* is contacted with the other direction surface in a thickness direction of the blocked portion 36*b*, the other direction surface in a thickness direction of the exterior protrusion supported portion 11*c* is contacted with one direction surface in a thickness direction of the body supported portion 38*c*. In other words, the pad-housing 30 is fixed to the body 10 as the body 10 and the pad-housing 30 are supported to an opposite direction with each other in a portion of disposing the coupling protrusion supported portion 11*b* and the blocked portion 36*b* and a portion of disposing the exterior protrusion supported portion 11*c* and the body supported portion 38*c*. Herein, in a state that the pad-housing 30 is inserted into the housing mounting hole 19 such that the body supported portion 38*c* of the pad-housing 30 is arranged to be blocked to the exterior protrusion supported portion 11*c* of the body 10, the body 10 and the pad-housing 30 are coupled with each other when the blocked portion 36*b* of the pad-housing 30 is arranged to be blocked to the coupling protrusion supported portion 11*b* of the body 10 as the body coupling protrusion 36 of the pad-housing 30 is easily pushed into the housing coupling groove 16 of the body 10 depending on elastic deformation of the body 10 and the pad-housing 30 by using the slanted surface 36*c* of the pad-housing 30.

Figure 8:
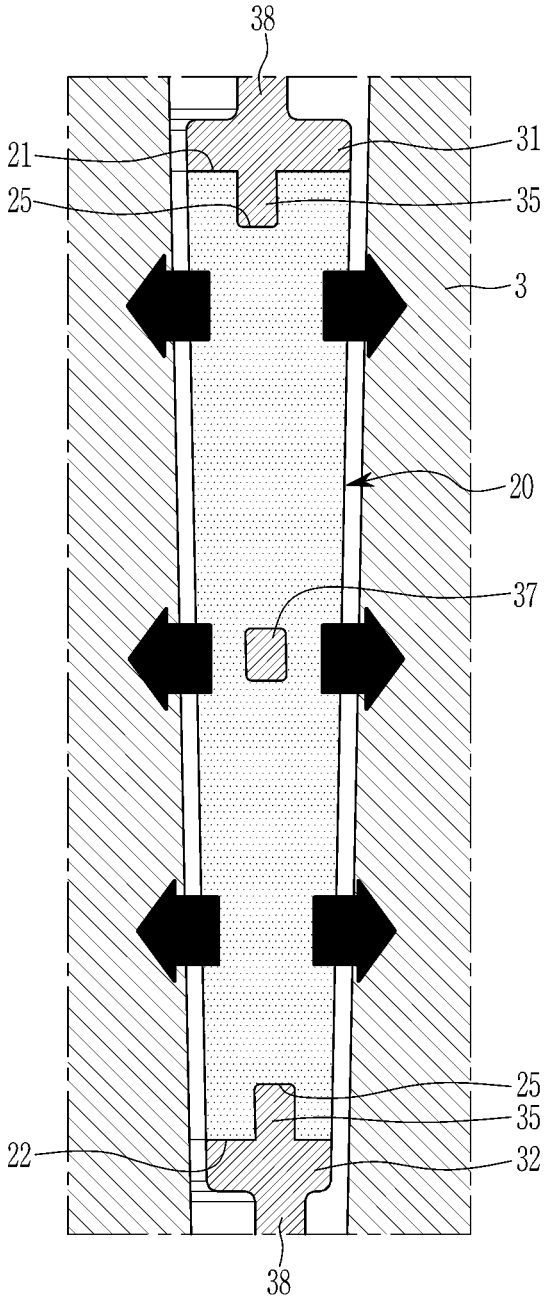
FIG. 8 is a cross-sectional view to illustrate performance of a structure mounted in a water jacket for a cylinder block according to an exemplary embodiment of the present invention.

FIG. 8 is a cross-sectional view to illustrate performance of a structure mounted in a water jacket for a cylinder block according to an exemplary embodiment of the present invention. In addition, FIG. 8 is a drawing for enlarging a part of FIG. 1 and illustrating the enlarged part as a plane.

As shown in FIG. 8, a structure 1 mounted in a water jacket for a cylinder block according to an exemplary embodiment of the present invention is inserted into the water jacket 7 of the cylinder block 3 after injection-molding the pad 20 to the pad-housing 30 and then coupling the pad-housing 30 with the body 10.

A structure 1 mounted in a water jacket for a cylinder block according to an exemplary embodiment of the present invention acts so that the pad 20 expands by contacting with coolant when coolant is flowed in the water jacket 7 in a state of being inserted into the water jacket 7. At this time, it is limited by respective the pad mounted upper end 31, the pad mounted lower end 32, the pad mounted one end 33, and the pad mounted other end 34 that the pad upper end 21, the pad lower end 22, the pad one end 23, and the pad other end 24 of the pad 20 are respectively expanded, and thus the pad 20 is expended in a thickness direction so as to contact to the cylinder block 3. When the pad 20 is contacted to the cylinder block 3 like this, area that coolant is contacted with the cylinder block 3 is reduced, thereby realizing warm block for keeping warmth of the cylinder block 3.

In FIG. 8, a direction of expanding the pad 20 is illustrated by arrows. Herein, as the pad 20 having the hydrophilic expansion rubber material is directly injection-molded to the pad-housing 30, members for assemble and support of the pad 20 such as a clip, a spring, and so on may be removed. In addition, a substantive thickness of a structure 1 mounted in a water jacket for a cylinder block according to an exemplary embodiment of the present invention can be to be thinner in comparison with an ordinary configuration by injection molding of the pad 20 and the above mentioned coupling type of the pad-housing 30 and the body 10. Therefore, inserting a structure 1 mounted in a water jacket for a cylinder block according to an exemplary embodiment of the present invention into the water jacket 7 or escaping the structure 1 from the water jacket 7 by a worker or a manufacturing device may be easy.

On the other hand, as area of contacting the pad 20 with the cylinder block 3 may be increased in comparison with an ordinary configuration, it is possible that the pad 20 is manufactured so that a thickness of the pad 20 is to be increased. Therefore, warm block performance can be improved by increasing area of contacting the pad 20 and the cylinder block 3, and as an established gap between the pad 20 and the cylinder block 3 is to be narrow, warm block performance can be ensured by realizing contact of the pad 20 and the cylinder block 3 even though expansion coefficient of the pad 20 is to be small.

The configuration that the pad 20 has small expansion coefficient means a configuration that little expansible resin is contained into the pad 20 formed of the hydrophilic expansion rubber material, and the material cost may be reduced as little expansible resin is contained thereinto. Further, as component generally having a SUS material, with which members such as the clip, the spring, and so on are integrally formed, is removed, necessary expenses may be reduced for providing a expensive SUS material component. Herein, the SUS which is one classification of a stainless steel material is well known to a person of an ordinary skill in the art, so a detailed description thereof will be omitted.

According to an exemplary embodiment of the present invention, an additional component for fixing the pad 20 is not required as the pad 20 is directly molded to the pad-housing 30 such that a number of components may be reduced and a process may be downsized. In addition, expansion coefficient required to the pad 20 is small such that the material cost may be reduced. Further, area of the cylinder block 3 to which the pad 20 is contacted is increased such that warm block performance may be improved, and simultaneously, entire capacity of coolant accepted into the water jacket 7 for the cylinder block is reduced such that cooling performance may be better by rapid circulation of coolant. Furthermore, as it is possible that the body 10 to which the pad 20 is mounted is manufactured to be thin, assembling the embed structure 1 with the water jacket 7 for the cylinder block or escaping the embed structure 1 from the water jacket 7 for the cylinder block may be to be easy.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A structure to be mounted in a water jacket for a cylinder block of an engine, the structure comprising:

a body forming a housing mounting portion comprising a panel formed in an arc shape so as to have inner and outer curved surfaces to be surrounded by a block bore, the housing mounting portion having a housing mounting hole;

a pad-housing formed in a plate shape to have curved surfaces with a curvature equal to the inner and outer curved surfaces of the housing mounting portion, the pad-housing inserted into the housing mounting hole and formed in a shape to correspond with the housing mounting hole; and a pad formed in a shape to correspond with a pad mounting hole which is bored through the pad-housing through, the pad having a curved surface and inserted into the pad mounting hole to achieve water tightness;

wherein the housing mounting portion comprises:

a housing mounted upper end closing an upper side of the housing mounting hole;

a housing mounted lower end disposed to face to the housing mounted upper end and adapted to close a lower side of the housing mounting hole;

a housing mounted one end connecting the housing mounted upper end with the housing mounted lower end and closing one side of the housing mounting hole; and a housing mounted other end disposed to face to the housing mounted one end and adapted to connect the housing mounted upper end with the housing mounted lower end and close the other side of the housing mounting hole;

wherein the pad-housing comprises:

a pad mounted upper end coupled to the housing mounted upper end so as to ensure water tightness and adapted to close an upper side of the pad mounting hole;

a pad mounted lower end coupled to the housing mounted lower end so as to ensure water tightness and disposed to face to the pad mounted upper end so as to close a lower side of the pad mounting hole;

a pad mounted one end coupled to the housing mounted one end so as to ensure water tightness and adapted to connect the pad mounted upper end with the pad mounted lower end and to close one side of the pad mounting hole; and a pad mounted other end coupled to the housing mounted other end so as to ensure water tightness and disposed to face to the pad mounted one end so as to connect the pad mounted upper end with the pad mounted lower end and to close the other side of the pad mounting hole;

wherein the pad comprises:

a pad upper end coupled to the pad mounted upper end so as to achieve water tightness;

a pad lower end coupled to the pad mounted lower end so as to achieve water tightness;

a pad one end coupled to the pad mounted one end so as to achieve water tightness; and a pad other end coupled to the pad mounted other end so as to achieve water tightness;

wherein the pad-housing further comprises an interior circumference protrusion protruded toward the pad mounting hole along interior circumferences of the pad mounted upper end, the pad mounted one end, the pad mounted lower end, and the pad mounted other end;

wherein the pad further comprises an interior protrusion coupling groove recessed in a shape to correspond with the interior circumference protrusion along the pad upper end, the pad one end, the pad lower end, and the pad other end such that the interior circumference protrusion is seated thereon;

wherein the pad-housing further comprises a stiffening rib formed in a bar shape to connect the interior circumference protrusion that is formed at the pad mounted one end with the interior circumference protrusion that is formed at the pad mounted other end so as to partition the pad mounting hole into two sections; and wherein the pad further comprises a rib hole bored into the pad from the interior protrusion coupling groove which is formed at the pad mounted one end to the interior protrusion coupling groove which is formed at the pad mounted other end and formed in a shape to correspond with the stiffening rib such that the stiffening rib is sat thereon.

2. The structure of claim 1, wherein the body is disposed in an up and down direction of the water jacket.

3. The structure of claim 1, wherein the body and the pad-housing are formed of a plastic material and the pad is formed of a hydrophilic expansion rubber material.

4. The structure of claim 1, wherein the structure includes a plurality of pad-housings and pads and wherein the body is formed in a plate shape having a plurality of housing mounting portions, the pad-housings and the pads being mounted respective housing mounting portions.

5. The structure of claim 1, wherein the interior circumference protrusion is formed so as to be continuously protruded to cross the pad mounted upper end, the pad mounted one end, the pad mounted lower end, and the pad mounted other end.

6. The structure of claim 1, wherein the pad mounting hole is halved by the stiffening rib.

7. The structure of claim 1, wherein the interior protrusion coupling groove is formed to be continuously recessed to cross the pad upper end, the pad one end, the pad lower end, and the pad other end.

8. The structure of claim 1, wherein the pad is directly injection-molded to the pad-housing.

9. The structure of claim 1, wherein thicknesses of the pad mounted upper end, the pad mounted lower end, the pad mounted one end, and the pad mounted other end are equal, and a thickness of the pad is formed to be uniform and to be equal to thicknesses of the pad mounted upper end, the pad mounted lower end, the pad mounted one end, and the pad mounted other end.

10. The structure of claim 1, wherein, when coolant is flowed in the water jacket, the pad contacting the coolant is expanded in a thickness direction so as to contact to the cylinder block in a state that it is limited by the respective pad mounted upper end, the pad mounted lower end, the pad mounted one end, and wherein the pad mounted other end that the pad upper end, the pad lower end, the pad one end, and the pad other end are respectively expanded.

11. A structure to be mounted in a water jacket for a cylinder block of an engine, the structure comprising:

a body forming a housing mounting portion comprising a panel formed in an arc shape so as to have inner and outer curved surfaces to be surrounded by a block bore, the housing mounting portion having a housing mounting hole;

a pad-housing formed in a plate shape to have curved surfaces with a curvature equal to the inner and outer curved surfaces of the housing mounting portion, the pad-housing inserted into the housing mounting hole and formed in a shape to correspond with the housing mounting hole; and a pad formed in a shape to correspond with a pad mounting hole which is bored through the pad-housing through, the pad having a curved surface and inserted into the pad mounting hole to achieve water tightness;

wherein the housing mounting portion comprises:

a housing mounted upper end closing an upper side of the housing mounting hole;

a housing mounted lower end disposed to face to the housing mounted upper end and adapted to close a lower side of the housing mounting hole;

a housing mounted one end connecting the housing mounted upper end with the housing mounted lower end and closing one side of the housing mounting hole; and a housing mounted other end disposed to face to the housing mounted one end and adapted to connect the housing mounted upper end with the housing mounted lower end and close the other side of the housing mounting hole;

wherein the pad-housing comprises:

a pad mounted upper end coupled to the housing mounted upper end so as to ensure water tightness and adapted to close an upper side of the pad mounting hole;

a pad mounted lower end coupled to the housing mounted lower end so as to ensure water tightness and disposed to face to the pad mounted upper end so as to close a lower side of the pad mounting hole;

a pad mounted one end coupled to the housing mounted one end so as to ensure water tightness and adapted to connect the pad mounted upper end with the pad mounted lower end and to close one side of the pad mounting hole; and a pad mounted other end coupled to the housing mounted other end so as to ensure water tightness and disposed to face to the pad mounted one end so as to connect the pad mounted upper end with the pad mounted lower end and to close the other side of the pad mounting hole;

wherein the pad comprises:

a pad upper end coupled to the pad mounted upper end so as to achieve water tightness;

a pad lower end coupled to the pad mounted lower end so as to achieve water tightness;

a pad one end coupled to the pad mounted one end so as to achieve water tightness; and a pad other end coupled to the pad mounted other end so as to achieve water tightness;

wherein the body further comprises a housing coupling groove formed within at least one of the housing mounted upper end, the housing mounted lower end, the housing mounted one end, and the housing mounted other end so as to be recessed toward an exterior side from an interior circumference; and wherein the pad-housing further comprises:

an exterior circumference protrusion protruded toward an exterior side along exterior circumferences of the pad mounted upper end, the pad mounted one end, the pad mounted lower end, and the pad mounted other end; and a body coupling protrusion protruded from the exterior circumference protrusion and adapted so that a part thereof is formed in a shape to correspond with the housing coupling groove so as to be seated on the housing coupling groove.

12. The structure of claim 11, wherein the exterior circumference protrusion is formed so as to be continuously protruded to cross the pad mounted upper end, the pad mounted one end, the pad mounted lower end, and the pad mounted other end.

13. The structure of claim 11, wherein the body coupling protrusion comprises:

a seated portion formed in a semicircle along an exterior circumference of the exterior circumference protrusion, the seated portion to be seated on the housing coupling groove;

a blocked portion adapted to have a radius that is longer than a radius of the seated portion and formed in a semicircle to be concentrically arranged in a thickness direction; and a slanted surface formed to be slanted with respect to a center of the semicircle of the blocked portion such that a radius of the blocked portion is gradually reduced as receding from the seated portion, as an external circumference of the blocked portion; and wherein a coupling protrusion supported portion, which is a portion to surround the housing coupling groove formed at respective the housing mounted upper end, the housing mounted lower end, the housing mounted one end, and the housing mounted other end, is contacted to an exterior side of the seated portion and is contacted to the blocked portion in a thickness direction.

14. The structure of claim 13, further comprising:

an exterior protrusion supported portion protruded toward an interior side along interior circumferences of the housing mounted upper end, the housing mounted one end, the housing mounted lower end, and the housing mounted other end; and a body supported portion protruded toward an exterior side along an exterior circumference of the exterior circumference protrusion;

wherein the body supported portion is contacted to interior sides of the housing mounted upper end, the housing mounted one end, the housing mounted lower end, and the housing mounted other end and is contacted to the exterior protrusion supported portion in a thickness direction.

15. The structure of claim 14, wherein the exterior protrusion supported portion is formed to be continuously protruded to cross the housing mounted upper end, the housing mounted one end, the housing mounted lower end, and the housing mounted other end except parts of forming the housing coupling groove; and wherein the body supported portion is formed to be continuously protruded to cross the entirety of the exterior circumference protrusion except parts of forming the body coupling protrusion.

16. The structure of claim 14, wherein one direction surface in a thickness direction of the coupling protrusion supported portion is contacted with another direction surface in a thickness direction of the blocked portion, and another direction surface in a thickness direction of the exterior protrusion supported portion is contacted with one direction surface in a thickness direction of the body supported portion.

17. The structure of claim 16, wherein the body and the pad-housing are coupled to each other when the blocked portion is passed through the housing coupling groove by using the slanted surface so as to be blocked to the coupling protrusion supported portion in a state that the pad-housing is inserted into the housing mounting hole such that the body supported portion is blocked to the exterior protrusion supported portion.

18. The structure of claim 11, wherein thicknesses of the pad mounted upper end, the pad mounted lower end, the pad mounted one end, and the pad mounted other end are equal, and a thickness of the pad is formed to be uniform and to be equal to thicknesses of the pad mounted upper end, the pad mounted lower end, the pad mounted one end, and the pad mounted other end.

19. The structure of claim 11, wherein the pad-housing further comprises an interior circumference protrusion protruded toward the pad mounting hole along interior circumferences of the pad mounted upper end, the pad mounted one end, the pad mounted lower end, and the pad mounted other end; and wherein the pad further comprises an interior protrusion coupling groove recessed in a shape to correspond with the interior circumference protrusion along the pad upper end, the pad one end, the pad lower end, and the pad other end such that the interior circumference protrusion is seated thereon.

20. The structure of claim 19, wherein the pad-housing further comprises a stiffening rib formed in a bar shape to connect the interior circumference protrusion that is formed at the pad mounted one end with the interior circumference protrusion that is formed at the pad mounted other end so as to partition the pad mounting hole into two sections; and wherein the pad further comprises a rib hole bored into the pad from the interior protrusion coupling groove which is formed at the pad mounted one end to the interior protrusion coupling groove which is formed at the pad mounted other end and formed in a shape to correspond with the stiffening rib such that the stiffening rib is sat thereon.

* * * * *